United States Patent [19]

Hayashibara et al.

[11] 4,428,719

[45] Jan. 31, 1984

[54] BRUSHLESS MOTOR FAN

[75] Inventors: Toshio Hayashibara; Kunihiro Noto, both of Katsuta; Yoshinori Fukasaku, Hitachi, all of Japan

[73] Assignee: Hitachi, Ltd., Tokyo, Japan

[21] Appl. No.: 260,275

[22] Filed: May 6, 1981

[30] Foreign Application Priority Data

May 14, 1980 [JP] Japan ..... 55-62836

[51] Int. Cl.[3] ..... F04B 35/04

[52] U.S. Cl. ..... 417/354; 417/423 R

[58] Field of Search ..... 417/354, 423 R; 415/106

[56] References Cited

U.S. PATENT DOCUMENTS

| | | | |
|---|---|---|---|
| 2,923,460 | 2/1960 | Galaba | 417/354 |
| 3,414,188 | 12/1968 | Gallie | 415/106 |
| 3,619,088 | 11/1971 | Bullock | 417/423 R |
| 3,700,358 | 10/1972 | Papst et al. | 417/354 |

*Primary Examiner*—Richard E. Gluck
*Assistant Examiner*—Peter M. Cuomo
*Attorney, Agent, or Firm*—Antonelli, Terry & Wands

[57] ABSTRACT

Provided is a brushless-motor fan unit having a centrifugal fan and a scroll casing enclosing the centrifugal fan therein. The rotor of the brushless-motor is carried by the centrifugal fan. Further, the motor shaft carrying the centrifugal fan is supported at its front and rear ends by the scroll casing. With this construction, the motor housing can be eliminated so as to obtain a compact centrifugal type motor fan unit in a small thickness as a whole.

8 Claims, 3 Drawing Figures

BRUSHLESS MOTOR FAN

BACKGROUND OF THE INVENTION

The present invention relates to a brushless motor fan unit and, more particularly, to a centrifugal type brushless motor fan unit in which a brushless motor and a centrifugal fan are constructed as a unit.

A typical conventional centrifugal motor fan unit has a centrifugal fan attached to the output shaft of a motor, the motor having a motor housing attached to the rear wall of a scroll chamber so that the output shaft may be directed toward the suction port formed in the front wall of the scroll chamber.

In the conventional centrifugal motor fan unit of the type stated above, since the motor having a large weight is supported solely by the rear wall of the scroll chamber, the rear wall is required to have a strength large enough to bear the large weight of the motor. In addition, the output shaft of the motor tends to oscillate undesirably. Furthermore, the presence of the motor housing impractically increases the size of the motor fan unit as a whole, to make it difficult to obtain a compact construction of the motor fan unit. It is also to be pointed out that, since the rotor usually constitutes the armature of the motor, it is not possible to effect the speed control in a simple manner.

SUMMARY OF THE INVENTION

Accordingly, an object of the invention is to provide a centrifugal brushless motor fan unit which can overcome the above-described problems of the prior art.

To this end, according to the invention, there is provided a centrifugal brushless motor fan unit in which a centrifugal fan is carried by a shaft which in turn is supported by a scroll and the rotor of a brushless motor is fixed to the centrifugal fan while the stator of the brushless motor is fixed to the scroll concentrically with the rotor, thereby to eliminate the necessity for the motor housing.

In the brushless motor fan unit of the invention, the stator of the motor acts as the armature while the rotor is a mere magnet, so that it is easy to obtain a dynamic balance and to afford an easier control of the operation speed.

The above and other objects, as well as advantageous features of the invention will become clear from the following description of the preferred embodiments taken in conjunction to the accompanying drawings.

DESCRIPTION OF THE PREFERRED EMBODIMENTS

Before turning to the detailed description of the preferred embodiments, an explanation will be given as to the conventional centrifugal motor fan unit with specific reference to FIG. 1, in order to facilitate the understanding of the remarkable effects offered by the invention.

Figure 1:
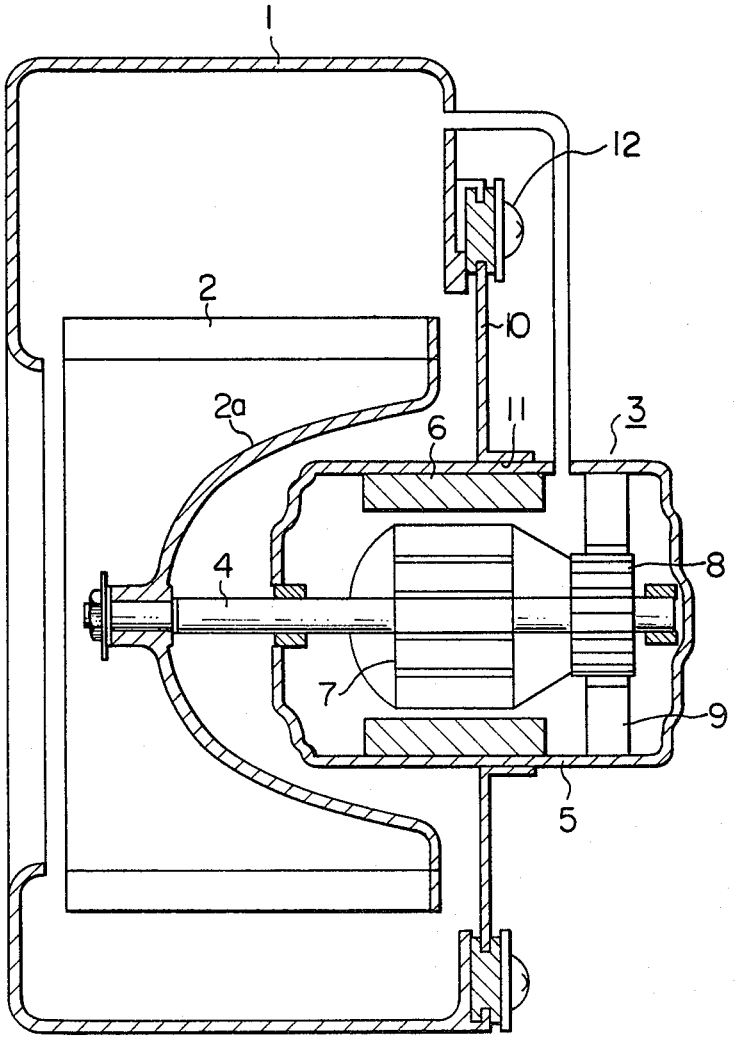
FIG. 1 PRIOR ART
FIG. 1 is a schematic sectional view of a conventional centrifugal motor fan unit.

Referring to FIG. 1, a scroll 1 for smoothing the flow of air accommodates a centrifugal fan 2 which is fixed to the output shaft 4 of a motor 3. The motor 3 is constituted by a housing 5, a stator 6 fitted in the housing 5, a rotor 7 fixed to the output shaft 4, a commutator fixed to the output shaft 4 and connected to the coils on the rotor 7 and brushes 9 mounted on the housing 5 and adapted to make sliding contact with the commutator 8. For mounting the motor 3, the housing 5 is fixed in a hole 11 formed in a mounting plate 10 which in turn is secured to the scroll 1 by suitable means such as screws 12.

In operation of this centrifugal motor fan unit, the centrifugal fan 2 makes a centrifugal action as the motor 3 is energized, so that the air is induced from the suction port A and is discharged after a smoothing by the scroll 1.

This conventional centrifugal motor fan unit has an impractically large number of parts, to require a complicated assembling work and increased cost of production, as well as increased number of steps of production.

Also, the size of the centrifugal fan unit as a whole is increased owing to the presence of the motor housing 3. Namely, the size of a wind guide dome **2*a* of the centrifugal fan 2, which receives the portion of the motor housing 5 adjacent to the output shaft, cannot be reduced so that the dome cannot have a form suitable for achieving an efficient guide of the wind. In addition, it is necessary to mount an air duct 12 for introducing draft air from the high pressure side of the scroll 1 into the motor housing 5**, in order to effectively cool the coils in the motor.

These problems or drawbacks of the conventional centrifugal motor fan unit, however, are eliminated in a centrifugal brushless motor fan unit of the invention, as will be understood from the following description of the preferred embodiments.

Figure 2:
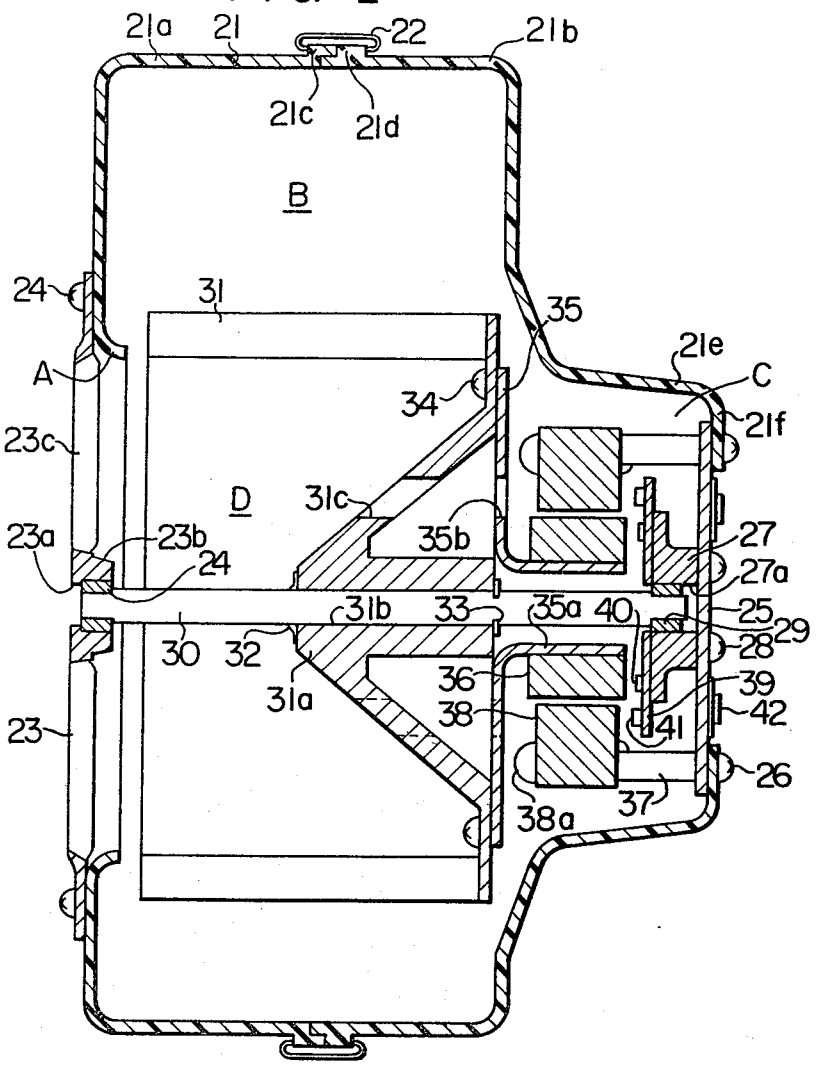
FIG. 2 is a schematic sectional view of a centrifugal motor fan unit constructed in accordance with a first embodiment of the invention.

FIG. 2 shows in section a centrifugal brushless motor fan unit constructed in accordance with a first embodiment of the invention.

In this centrifugal brushless motor fan unit of the invention, a scroll casing 21 is constituted by a front housing **21*a* and a rear housing 21*b* which are secured to each other by means of a clip 22 which makes snap fit around opposing protrusions 21*c*, 21*d* on both housings 21*a*, 21*b*. The combination of the clip and the protrusions are formed at a plurality of portions on the circumference of the housings along the juncture between two housings. The front housing 21*a* is provided with a suction port A formed therein. Radial vanes or grid 23 is fixed to the front housing 21*a* at a portion of the latter around the periphery of the suction port A, in such a manner as to extend radially over the front opening of the suction port A. The central portion of the radial grid 23 constitutes a front supporting block 23*b* having a bore 23*a* in which mounted is a front bearing 24. The vanes or grid bars of the radial grid 23** have the forms of guide vanes for reducing the resistance encountered by the flow of air sucked into the suction port A.

On the other hand, the portion of the rear housing **21*b* opposing to the suction port A of the front housing 21*a* has a cylindrical wall 21*e* which extends rearwardly to define an accommodation space (C). The cylindrical wall 21*e* is provided at its rear end with an annular flange 21*f*. A cover plate 25 is fixed to the annular flange 21*f* by means of screws 26. A rear supporting block 27** having a bore 27*a* is fixed to the cover plate 25 by means of screws 28. A rear bearing 29 received by the bore 27*a* is held coaxially with the front bearing 24.

The front bearing 24 and the rear bearing 29 in cooperation support a shaft 30 at respective ends of the latter. A centrifugal fan 31 is disposed in a scroll chamber B defined between the suction port A of the scroll casing 21 and the accommodation space C.

The shaft 30 is tightly received by a through bore 31*b* of a conical hub 31*a* of the centrifugal fan 31 so as to carry the latter. The axial movement of the centrifugal fan 31 along the shaft 30 is prevented by the cooperation of an inner clip member 32 and an E-ring 33. The conical hub 31*a* has an apex directed toward the suction port A, so that the conical hub 31*a* functions as a deflector for the flow of air coming into the motor fan unit.

A rotor carrying bracket 35 is fixed by means of a screw 34 to the rear side of the base portion of the conical hub 31*a*. The bracket 35 has a rearwardly extending cylindrical portion 35*a* which surrounds the shaft 30. A magnet rotor 36 is secured to the cylindrical portion 35*a* coaxially with the shaft 30. The conical hub 31*a* is provided with a plurality of ventillating holes arranged at a predetermined circumferential pitch around the through bore 31*b*. Similar ventilating holes 35*b* are formed also in the bracket 35. These ventilating holes 31*c*, 35*b* are provided for a ventillation of the space inside the cylindrical wall 21*e* as will be explained later.

A stator 38 is supported through a supporting member 37 by the cover plate 25, concentrically with the cover plate 25. The stator 38 is provided with a coils 38*a*. The rear supporting block 27 is provided at its side facing the rear end surface of the rotor 36 with a base plate 39. A plurality of circumferentially spaced sensors 40 are mounted on the base plate 39 to take positions opposing the rear end of the rotor 36. The sensors 40 are used for detecting the positions of magnets on the rotor 36. Upon detecting the positions of the magnets, the sensors 40 deliver respectively signals to a control circuit 41 on the base plate 39. The control circuit 41 is adapted to control power transistors 42 which are mounted on the cover plate 25 at a predetermined circumferential pitch, to regulate the electric current in the coils 38*a* so as to regulate the rotation speed of the rotor.

As will be seen from the foregoing description, in the centrifugal motor fan unit of the invention, the motor housing, which is indispensable in the conventional motor fan unit, is eliminated because the rotor 36 is supported by the centrifugal fan 31 itself. In consequence, the construction of the motor fan unit as a whole is made compact. In addition, since the motor housing is eliminated, it is not necessary to provide an air duct for cooling the coils 38*a* of the motor.

The air induced through the suction port A as a result of operation of the centrifugal fan 31 is pressurized at the discharge portion B of the scroll 21. A part of this pressurized air is relieved from the discharge portion B into the accommodation space C in the cylindrical wall 21*e* of the rear housing 21, via the ventilating holes 31*c*, 35*b* formed in the conical hub 31*a* and bracket 35 of the centrifugal fan 31, and is then returned to the area near the suction port A after cooling the coils 38*a* of the stator disposed in the accommodation space C.

It is also to be noted that the undesirable oscillation of the rotor shaft 30 of the centrifugal fan 31 is avoided because the rotor shaft is stably supported at its both ends. Furthermore, since the motor has no portion projected into the centrifugal fan 21, it is possible to make the hub 31*a* have any desired shape and size to act as a deflector having a high efficiency from the view point of fluid dynamics. It was confirmed through experiments that the conical shape of the hub as in the illustrated embodiment is quite effective.

In the embodiment described heretofore, the thickness of the centrifugal motor fan unit as a whole is reduced because a brushless motor is used as the motor for driving the centrifugal fan.

Figure 3:
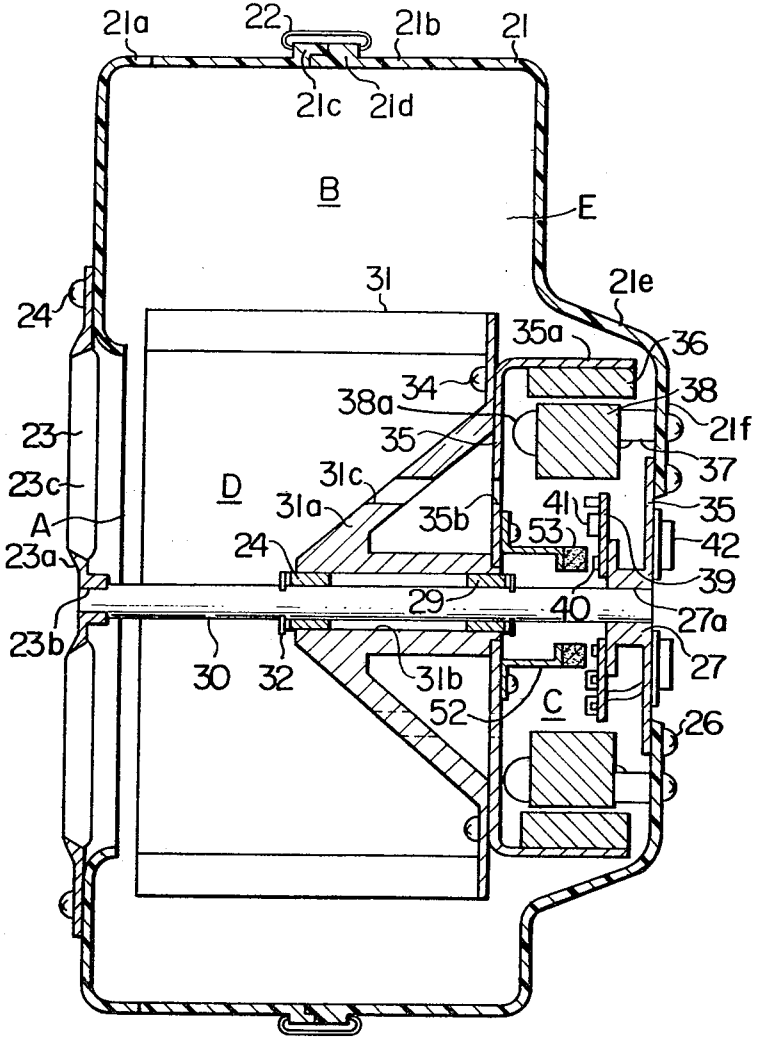
FIG. 3 is a schematic sectional view of a centrifugal motor fan unit constructed in accordance with a second embodiment of the invention.

A second embodiment of the invention will be described with reference to FIG. 3. In FIG. 3, the same reference numerals are used to denote the same parts or members as those used in FIG. 2. In the centrifugal motor fan unit of the second embodiment, the shaft 30 does not rotate but is fixed to the scroll 21, while the centrifugal fan 31 is rotatably carried by the shaft 30 through bearings 24, 29. The rotor 36 is disposed to surround the stator 38.

A plurality of magnets 53 are fixed to the inner peripheral surface of the rotor 36 through supporting members 52 so as to oppose to the sensors 40, so that the rotary position can be detected by the cooperation between the magnets 53 and the sensors 40. These sensors 40 are associated with respective output transistors 42 to constitute, in combination with a control circuit 41, a speed control device for controlling the operation speed of the motor fan unit. These output transistors are adapted to control the supply of the electric current to the stator 38. Namely, the magnets 53 are arranged to rotate together with the rotor 36, while the sensors 40 opposing to the magnets 53 are arranged on a circle centered at the shaft 30 at an angular pitch of, for example, 60°.

This embodiment offers an advantage that the heat radiation plate for radiating the heat from the output transistors 42 can be dispensed with, because the cover plate 35, forming part of rear supporting block 27, functions as the heat radiation plate.

In this embodiment, since the motor is a brushless motor, the armature can be constructed as the stator 38 so that it is possible to diminish the length of the electric wiring between the output transistors 42 and the stator 38 in which a large electric current flows, thereby to remarkably decrease the resistance loss.

Also, since a high air pressure is established at the discharge side A of the scroll 21 as a result of operation of the centrifugal fan 31, a part of the air is naturally relieved into the accommodation chamber C, so that the coils 38*a* of the stator and the base plate 39 are effectively cooled without taking any special measure such as a ventilation air duct.

Namely, it is possible to form, by providing ventilating holes 31*c* and 35*b* in the conical hub 31*a* and the bracket 35 of the centrifugal fan 31, a flow of air flowing from the discharge portion B of the scroll to the suction area D via the accommodation chamber C, to effectively cool the stator 38 and the circuit board 39. In this case, it is possible to dispose the output transistors 42 in the accommodation chamber C because the transistors can effectively be cooled by the drafted air.

In addition, since the motor is of a commutatorless motor having a rotor 36 consisting of magnets, the dynamic balancing of the rotary mass can be obtained more easily than in the conventional motor fan unit in which the rotor carries coil windings which causes a mass unbalance due to inferior precision of the coil winding.

In the motor fan unit of the second embodiment, the shaft 30 is supported by supporting blocks 23*a*, 27*a* which in turn are fixed to the scroll 21 so that the rigidity of the scroll 21 can be increased considerably. In addition, since the bearing 24 is not subjected to the incoming air, the undesirable scattering of grease charged in the bearing 24 is fairly avoided.

Furthermore, the iron loss attributable to the magnetic flux leaked from the scroll 21 is completely obviated because the scroll 21 is made of a resinous material.

From the foregoing description, it will be seen that, according to the invention, the construction of the rotor and stator is simplified to reduce the number of parts and the number of steps to remarkably lower the cost of production, thanks to the unitary construction of the centrifugal fan and the electric motor.

Although the invention has been described through specific terms, it is to be noted here that the described embodiments are only for illustrating purpose, and various changes and modifications may be imparted thereto without departing from the spirit or scope of the invention which is limited solely by the appended claims.

What we claim is:

1. In a brushless motor fan unit of centrifugal type, comprising: a scroll casing having an inlet port, a scroll space and a compartment located on a side of said scroll space opposite said inlet port; a brushless motor accommodated in compartment and including a rotor, a stator concentric with said rotor and a shaft concentric with said rotor and having a front and a rear end; a centrifugal fan supported in said scroll space by said shaft and driven by said rotor, said centrifugal fan having a rear end part onto which a conical hub is concentrically attached, having an apex directing toward said inlet port; and a power unit for energizing said brushless motor, wherein the improvement comprises front means, positioned at said inlet port, for supporting said front end of said shaft and rear means, positioned in said compartment, for supporting said rear end of said shaft, said rotor being directly attached to a side of said rear end part that is opposite the side to which said conical hub is attached, concentrically therewith, and said stator being attached to said scroll casing with said compartment.

2. A brushless-motor fan unit as set forth in claim 1, wherein said front and rear means rotatably support said shaft.

3. A brushless-motor fan unit as set forth in claim 2, wherein said rotor is surrounded by said stator.

4. A brushless motor fan unit as set forth in claim 1, wherein said rotor surrounds said stator.

5. A brushless-motor fan unit as set forth in claim 3 or 4, wherein said power unit includes a speed control device having rotor position sensors, control circuits and power transistors feeding an electrical power to said stator.

6. A brushless-motor fan unit as set forth in claim 5, wherein said rotor position sensors and said control circuits are disposed in said compartment.

7. A brushless-motor fan unit as set forth in claim 5, wherein said speed control device as a whole disposed in said compartment.

8. A brushless motor fan unit as set forth in claim 1, wherein said conical hub defines therein ventilating holes through which a cooling-air circulation is established by way of said compartment.

* * * * *